US005262757A

United States Patent [19]

Hansen

[11] Patent Number: 5,262,757

[45] Date of Patent: Nov. 16, 1993

[54] ELECTRONIC SIGNALING DEVICE FOR BICYCLES AND THE LIKE

[75] Inventor: Guy Hansen, Ketchum, Id.

[73] Assignee: Cyclert, Inc., Ketchum, Id.

[21] Appl. No.: 832,225

[22] Filed: Feb. 7, 1992

[51] Int. Cl.[5] ..... G08B 3/00

[52] U.S. Cl. ..... 340/427; 340/429; 340/432; 340/523; 340/328; 340/384 E

[58] Field of Search ..... 340/384 E, 384 R, 692, 340/427, 429, 430, 328, 432, 523

[56] References Cited

U.S. PATENT DOCUMENTS

| | | | |
|---|---|---|---|
| 3,587,094 | 6/1971 | Scott . | |
| 3,707,716 | 12/1972 | Goralnick | 340/384 E |
| 3,728,675 | 4/1973 | Horn et al. | 340/429 |
| 3,755,778 | 8/1973 | Kennedy et al. | 340/429 |
| 3,893,107 | 7/1975 | Schedler . | |
| 4,151,514 | 4/1979 | Haynes | 340/384 E |
| 4,204,200 | 5/1980 | Beyl, Jr. . | |
| 4,222,040 | 9/1980 | Benson et al. . | |
| 4,482,888 | 11/1984 | Todaka et al. | 340/384 E |
| 4,768,022 | 8/1988 | Patterson | 340/384 E |
| 4,890,093 | 12/1989 | Allison et al. | 340/565 |
| 4,946,416 | 8/1990 | Stern et al. . | |
| 4,980,667 | 12/1990 | Ames | 340/432 |
| 4,980,837 | 12/1990 | Nunn et al. | 340/384 E |

OTHER PUBLICATIONS

Wall Street Journal, Dec. 27, 1991 p. 132.

Bicycling, Dec., 1991 p. 40.

"IBM Technical Disclosure Bulletin" vol. 27 No. 6 Nov. 1984.

"Tone Generator" by M. Ferry, M. Geneste and C. Jacquart.

*Primary Examiner*—John K. Peng

*Assistant Examiner*—Nina Tong

*Attorney, Agent, or Firm*—Frank J. Dykas; Craig M. Korfanta; Ken J. Pedersen

[57] ABSTRACT

An electronic audible warning device (10), which includes a power source (18), a motion detector (401), a pleasant tone generator (100, Q1, Q3), a loud piercing tone generator (100, Q1, Q2) and a remote push button activation switch (19) is disclosed. Signaling device (10) provides two distinct features, each responsive to remote activation switch (19). A single depression on push button switch (19) will sound an unobtrusive, pleasant sounding two second pulsating warning tone. Two consecutive pushes on push button (19) will sound an attention-getting pulsating signal, similar to the backup beeper on commercial trucks, which will continue to sound until button (19) is pressed again. An additional feature is provided which is responsive to a motion detector (401). Here, a loud, piercing tone is sounded whenever a bicycle (1) or similarly attached article is moved. The alarm is activated and deactivated via an electrical key switch (402) which is installed directly in main housing (11).

5 Claims, 7 Drawing Sheets

ELECTRONIC SIGNALING DEVICE FOR BICYCLES AND THE LIKE

BACKGROUND OF THE INVENTION

1. Technical Field.

This invention generally relates to audible warning devices for bicyclers, roller skaters, and the like. More particularly, this invention relates to an electronic audible warning device which also has a motion detection and actuation means to provide for a theft warning device.

2. Background Art.

Bicyclists have long recognized the need to warn others that a bicycle is approaching. Forced air horns, bells and the like have been around almost as long as bicycles themselves. A resurgence of physical activity such as bicycling, skiing and roller skating has amplified the need to warn others that a sport enthusiast is quickly approaching, especially from behind.

The problem is even more critical with the nationwide trend of developing bicycle and walking paths through quiet areas. As a result of the increasing popularity of these paths, they have become quite crowded and can be hazardous. Typically, cycling and skating are fairly nonintrusive forms of recreation and a person on a path is often unaware that someone else is quickly approaching from behind. As a result, the person who is attempting to overtake the slower person will often yell or honk their horn, both of which sounds disturb the natural serenity of the surroundings and startle the other path user, sometimes doing more harm than good. Most of the time cyclists on bike paths and other nonmotorized recreation corridors do not need to sound an excessively loud and startling signal to alert other users. However, in urban settings with lots of loud vehicular traffic, a piercing signal becomes necessary.

Without the use of these warnings, the courteous cyclist is forced to slow down to the speed of the person whom they are trying to pass. However, even this places the slower person on the path in a precarious position and sometimes startled state of mind, as he or she will not learn of the passing cyclist until the last possible moment and will make a split-second decision on whether to move to the right or to the left. Unfortunately, the cyclist also makes a last-second decision, waiting for the slower person to commit, often resulting in both people moving in the same direction and colliding.

An additional problem with bicycles addressed by this invention is that bicycles are susceptible to tampering and theft. Frequently, they are left locked to a bicycle rack unattended for extended periods of time, and even locked bicycles are stolen.

The prior art of which the inventor is aware, does not provide a complete solution to all of these problems. For example, BENSON et al., U.S. Pat. No. 4,222,040, teaches an electronic siren and remote momentary-action push button switch for mounting on the handlebars of a bicycle. Unfortunately, this device emits an intrusive sound and provides no means to prevent tampering and theft.

What is needed is a warning device which, when in a quiet area such as a non-motorized recreation corridor, can be heard at acceptable distances and yet at the same time emits a sound which is not as disruptive as the sound emanating from a bicycle horn or bell; and, when in a loud urban setting, can emit a loud piercing tone.

Also, what is needed is a warning device which also has a motion detection and activation means to provide for a theft warning device.

It is therefore one of the objects of the present invention to provide an electronic audible warning device which in one mode emits a pleasant, simple and polite sound to warn others of an approaching cyclist, roller skater or the like, and in a second mode emits a loud piercing tone capable of being readily heard in a loud urban environment. It is a further object of the present invention to provide an audible warning device in accordance with the previous objective which will help prevent tampering and/or theft. It is yet another object of the present invention to provide an audible warning device in accordance with the previous two objectives and which is adaptable for use by a cyclist, a roller skater, a jogger, a snow skier, or any other activity in which it is desirable for an approaching person to warn another.

DISCLOSURE OF INVENTION

These and other objects are accomplished by an electronic audible warning device which includes a power source, a motion detector, a pleasant tone generation means, a loud piercing tone generation means and a remote push button activation switch. While the exact configuration is dependent upon any particular application, generally speaking the power source, motion detection activation means and both the tone generation means are all housed in a single housing, which includes a clip, bracket or other suitable attachment means for attaching the housing to a bicycle, belt, ski poles or other suitable location.

The electronics of the signaling device provide at least two distinct features, each responsive to the remote activation switch. A single depression on the push button switch will sound an unobtrusive, pleasant sounding two second pulsating warning tone. Two consecutive pushes on the button will sound an attention-getting, piercing, pulsating signal, similar to the backup beeper on commercial trucks, which will continue to sound until the button is depressed a third time. Additional features, each responsive to the remote activation switch, may be added. For example, three consecutive pushes on the button may sound the pleasant, two-second warning tone, which may continue and repeat to sound every 10 seconds, for example, until the button is depressed a fourth time. Also, the distinct features described above may be adjusted to respond to different sequences of depressions of the remote activation switch.

An additional optional feature may be provided wherein the loud piercing tone operation means is responsive to a motion detector. Here, a loud, piercing tone is sounded whenever the bicycle is moved. The alarm is activated and deactivated via a keyed electrical switch which is installed directly in the main housing.

Other optional features include the addition of a solar cell in connection with rechargeable batteries and the use of a wireless switch. Also, this invention could easily be incorporated into the package of a standard digital speedometer/odometer already on the market. In this particular configuration, the motion sensing function could be supplemented or replaced with the Hall effect, or similar, transducer used by the speedometer to count the number of wheel revolutions of the bicycle. Alternatively, the motion sensing function can be implemented using a mercury switch or its mechanical or solid state equivalent.

The functional features of the electronic signaling device can be implemented using either a microprocessor approach or a discrete component approach. In either case, a piezo element, or similar sound transducer, is employed to convert the circuit output into an audible signal. Both the circuit and the sound transducer can be powered by either lithium type miniature cells, the combination of rechargeable cells and a solar cell or any other suitable small power source.

BEST MODE FOR CARRYING OUT INVENTION

Figure 1:
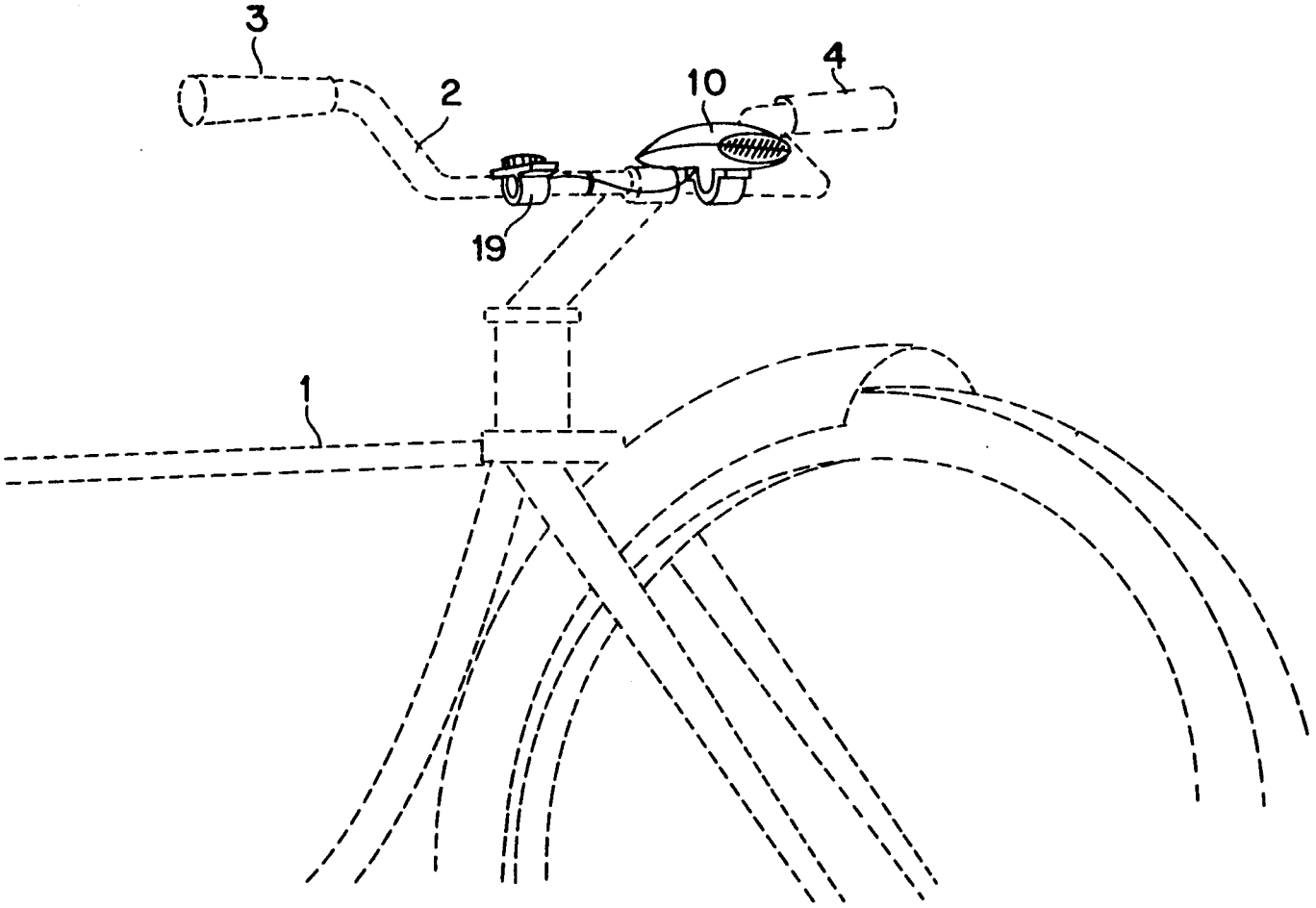
FIG. 1 is a three quarter elevation view of the electronic signaling device for bicycles.
Figure 2:
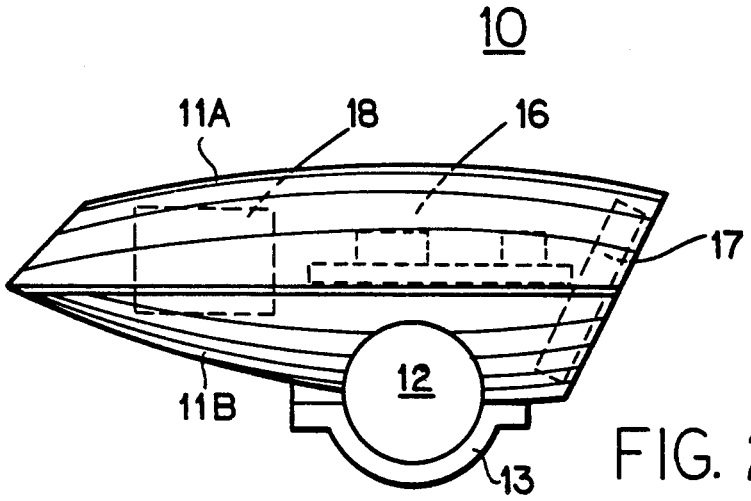
FIG. 2 is a right side view of the electronic signaling device, the left side of which is a mirror image thereof.
Figure 3:
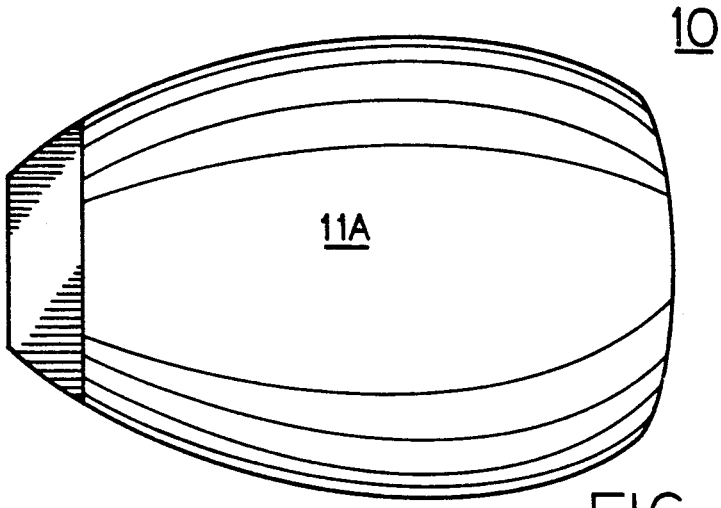
FIG. 3 is a top view of the electronic signaling device.
Figure 4:
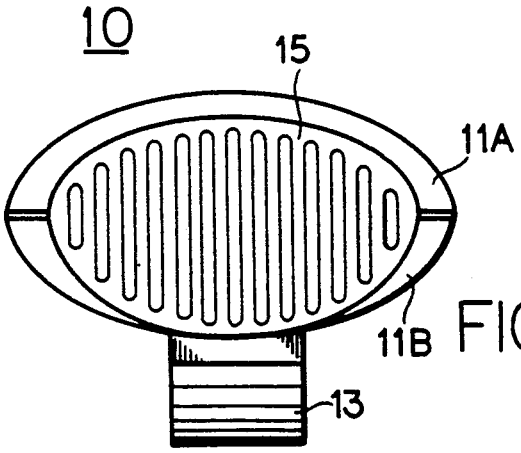
FIG. 4 is a front view of the electronic signaling device.
Figure 5:
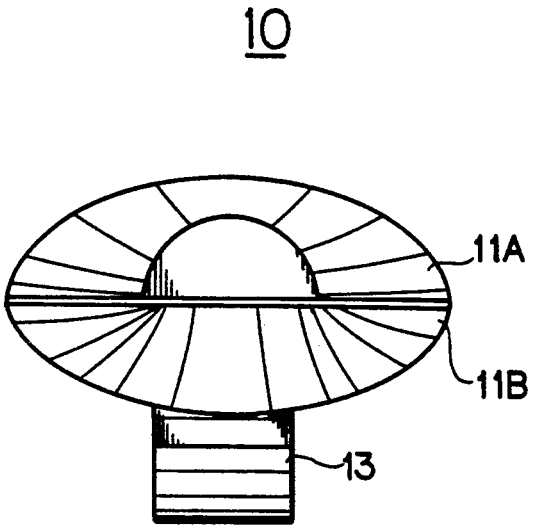
FIG. 5 is a back view of the electronic signaling device.
Figure 6:
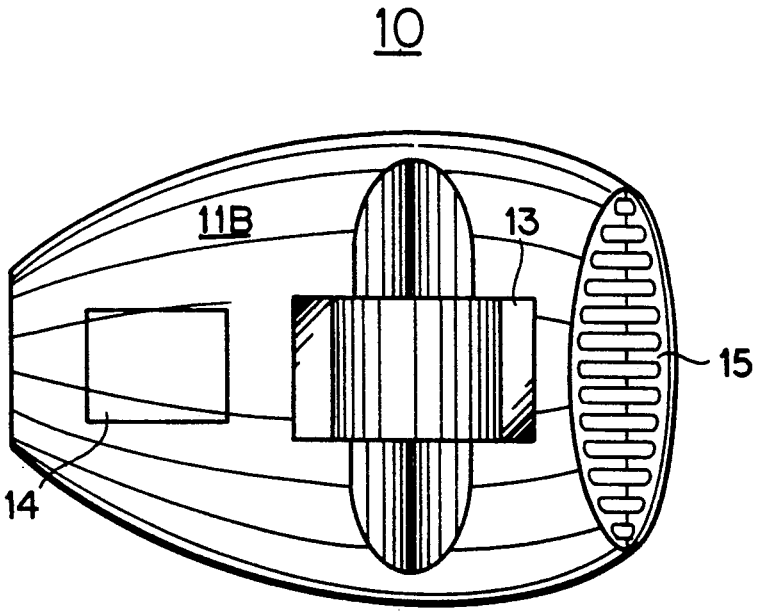
FIG. 6 is a bottom view of the electronic signaling device.

Referring now to the figures, both the outer aesthetic appearance and the inner electronic configuration are illustrated for an electronic audible signaling device 10. Housing 11 of the signaling device 10 is here constructed of a high impact resistent plastic using standard injection molding techniques. Housing 11 has four cooperating parts: the upper housing half 11A, the lower housing half 11B, a battery access panel 14 and a handle bar clamp 13. As is shown in the side view of FIG. 2 and the bottom view of FIG. 6, bottom housing half 11B has both a handle bar receiving channel 12 and a battery access hole (shown covered by battery access panel 14 in FIG. 6) formed therein. The front portions of upper and lower housing halves 11A and 11B are shaped to form a sound grill 15. Sound transducer 17, shown in broken lines, is positioned directly behind sound grill 15 such that the sound emitted by the transducer 17 will naturally travel outwardly from sound grill 15.

The upper and lower housing halves 11A and 11B, are connected one to the other using a suitable attachment means such as a snap fit arrangement, glue, ultrasonic welding or the like to form an impact resistant encasement for circuit board 16, sound transducer 17 and batteries 18. Battery access panel 14 is removably attached by one of a number of different means over the battery access hole. Here, the panel has a lip or tab extending from the front edge of the panel and a hook type latch depending from the inside rear edge of the panel, both the latch and lip acting to engage the inside front and rear edges of the battery access hole and thereby hold the panel in place.

A remotely located momentary push button switch 19 is provided with a similar handle bar attachment means. Switch 19 can either be electrically coupled to the main housing electronics with a suitable wire or, an electromagnetic radio frequency couple can be provided by employing a miniature transmitter within the push button switch assembly and a miniature receiver within main housing 11 to receive and react to the signal transmitted by push button switch 19.

Figure 7:
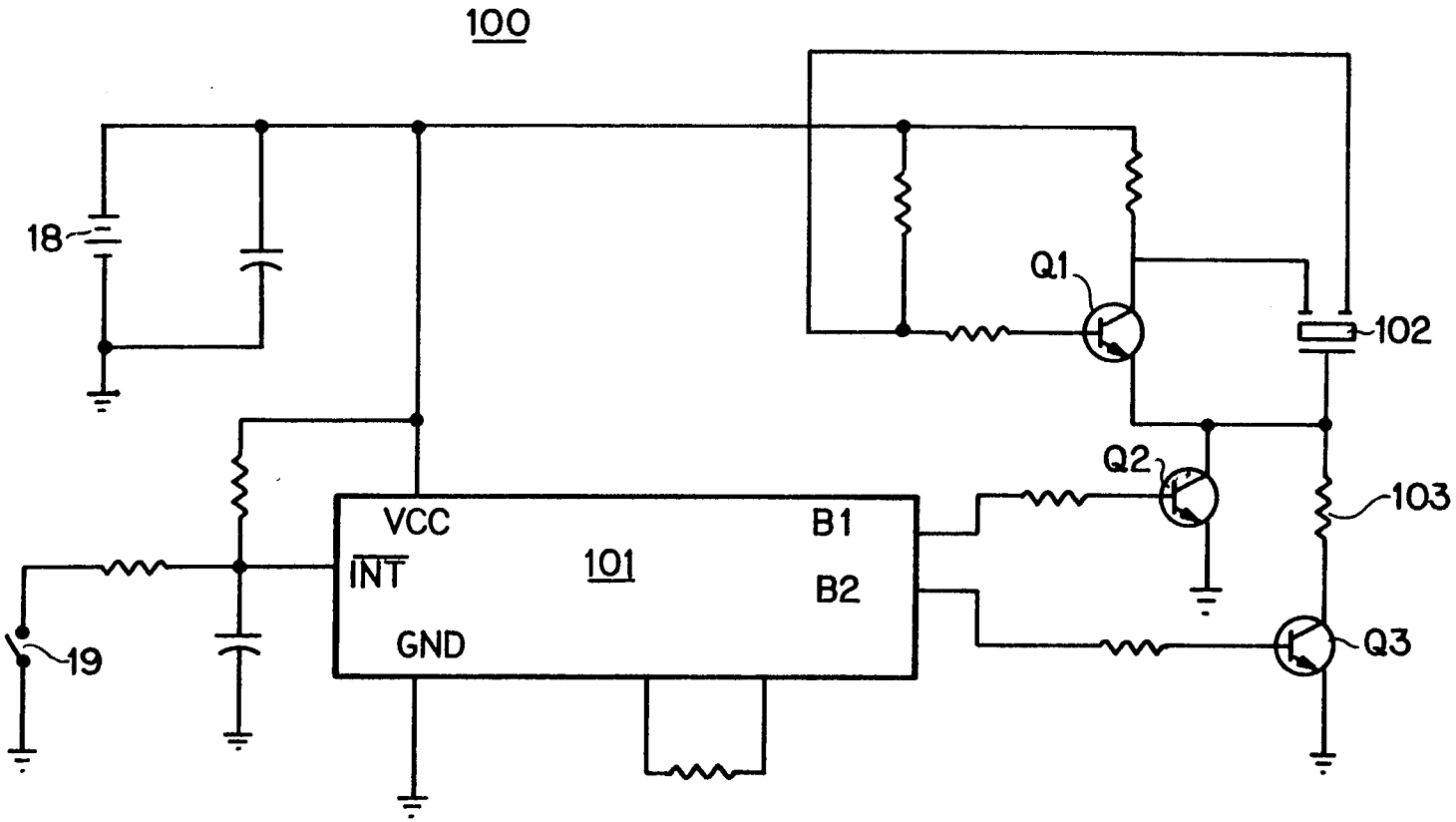
FIG. 7 is a schematic of the first microprocessor embodiment of the circuit.

The electronic functions of the device can be accomplished in at least two distinctly different embodiments, each having a number of alternative configurations and options. For example, a first microprocessor based embodiment 100 is shown in schematic form in FIG. 7. In this embodiment, circuit 100 derives its power from a pair of lithium watch type batteries shown at 18.

An eight bit MOTOROLA 6805 microprocessor, designated in the figures as 101, is employed to control and selectively activate the sound transducer 17, of FIGS. 1 through 6, which in this embodiment, is a piezo element 102 (PKM29-3A0). Piezo element 102 is driven at its resonant frequency, which in this preferred embodiment is 3.3 khz, by the piezo driver circuit containing NPN switching transistor Q1 (2N4401).

Microprocessor 101 includes a built-in 1k ROM which is configured to produce distinct output pulses at outputs B1 and B2 dependent on the input received at interrupt input INT. Because the INT input is active low, microprocessor 101 will respond to a negative pulse or a transition from positive to negative at the INT input. This negative pulse is provided by temporarily closing momentary push button switch 19. The ROM is configured such that a single negative pulse at the INT input will cause approximately three separate series of eight or ten short duration pulses to be emitted at B2. Each pulse will cause transistor Q3 to switch on, thereby completing the circuit through the current limiting resistor 103 and causing piezo element 102 to sound with each pulse. Likewise, a series of two negative pulses at the INT input will cause a continuous series of four pulses and a short pause to be emitted at the B1 output. Each of these pulses causes transistor Q2 to switch on, which completes the piezo circuit directly to ground, causing piezo 102 to sound loudly.

Figure 8:
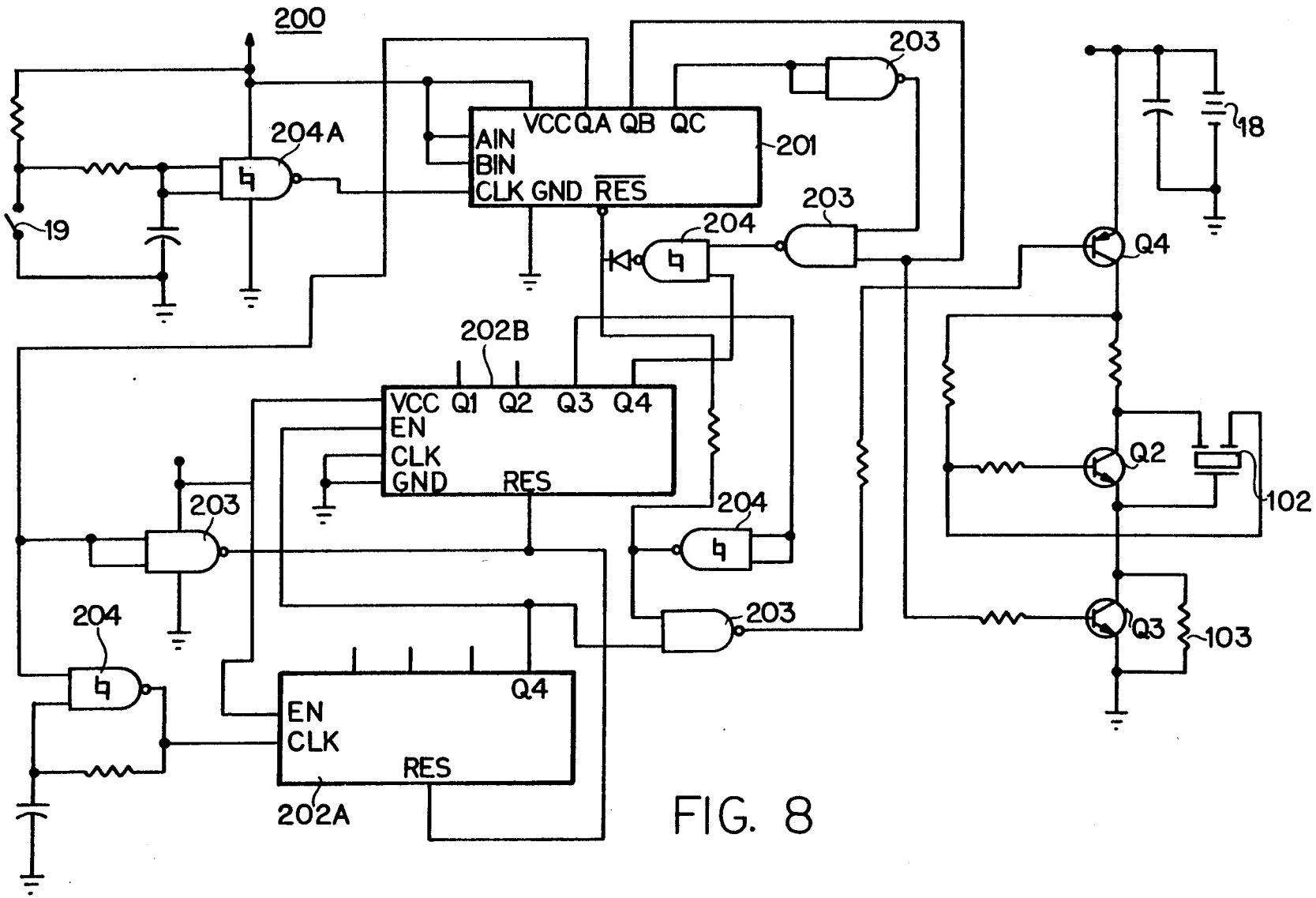
FIG. 8 is a schematic of the first discrete component embodiment of the circuit.

A discrete component embodiment 200 is shown in FIG. 8. The discrete component embodiment provides nearly the same functions as the previous microprocessor embodiment 100, with the exception of the number and duration of the sound pulses emitted in response to a single depression of momentary push button switch 19. In this embodiment, a single push of switch 19 will result two groups or series of four negative pulses being applied to the base of transistor Q4 (2N4403). However, transistor Q3 is not active and hence current will be forced through current limiting resistor 103, resulting in a quieter tone from piezo 102. Two pushes of momentary switch 19 will result in four separate groups of four pulses being applied to the base of transistor Q4 and in transistor Q3 being activated which will then pass current directly to ground, without passing through a current limiting resistor, resulting in a louder tone from piezo 102.

Each depression of momentary switch 19 pulls the inputs of a first NAND gate 204A (4093) low, which in turn applies a positive pulse to the CLK input of the eight bit shift register 201 (74HC164). The first pulse is shifted into the first register and appears at output QA. A second pulse will result in positive outputs at both QA and QB, while a third pulse will result in positive outputs at QA, QB and QC, at which time the shift register 201 is reset. As soon as QA goes high, i.e. has a positive value, a second NAND gate 204B, in combination with a resistor and capacitor, will begin to oscillate. The output of this oscillator circuit is divided by 8 using a first dual binary counter 202A (4520B). The output Q4 of the first binary counter 202A clocks a second dual binary counter 202B.

Second binary counter 202B counts in binary from zero to eight at which time it is reset. The following chart shows the values which appear at the at the output pins of the second binary counter 204B. A "1" corresponds to a high or positive signal while a "0" corresponds to a low or no signal.

| Number of Cycles | State of Output Pin on Binary Counter 202b | | | |
|---|---|---|---|---|
| | Q1 | Q2 | Q3 | Q4 |
| 0 | 0 | 0 | 0 | 0 |
| 1 | 1 | 0 | 0 | 0 |
| 2 | 0 | 1 | 0 | 0 |
| 3 | 1 | 1 | 0 | 0 |
| 4 | 0 | 0 | 1 | 0 |
| 5 | 1 | 0 | 1 | 0 |
| 6 | 0 | 1 | 1 | 0 |
| 7 | 1 | 1 | 1 | 0 |
| 8 | 0 | 0 | 0 | 1 |

Please note that the first, second and third clock cycles do not result in any output from the Q4 output of the second binary counter 202B. The fourth through seventh clock cycles however, result in a logic high at output Q4 of second binary counter 202B which activates transistor Q4 and piezo element 102 will sound four times, once for each of cycles four through seven. The eighth cycle resets shift register 201. Both binary counters 202A and 202B are reset when the QA output on shift register 201 becomes low by inverting the QA output signal via a NAND gate 203.

Figure 9:
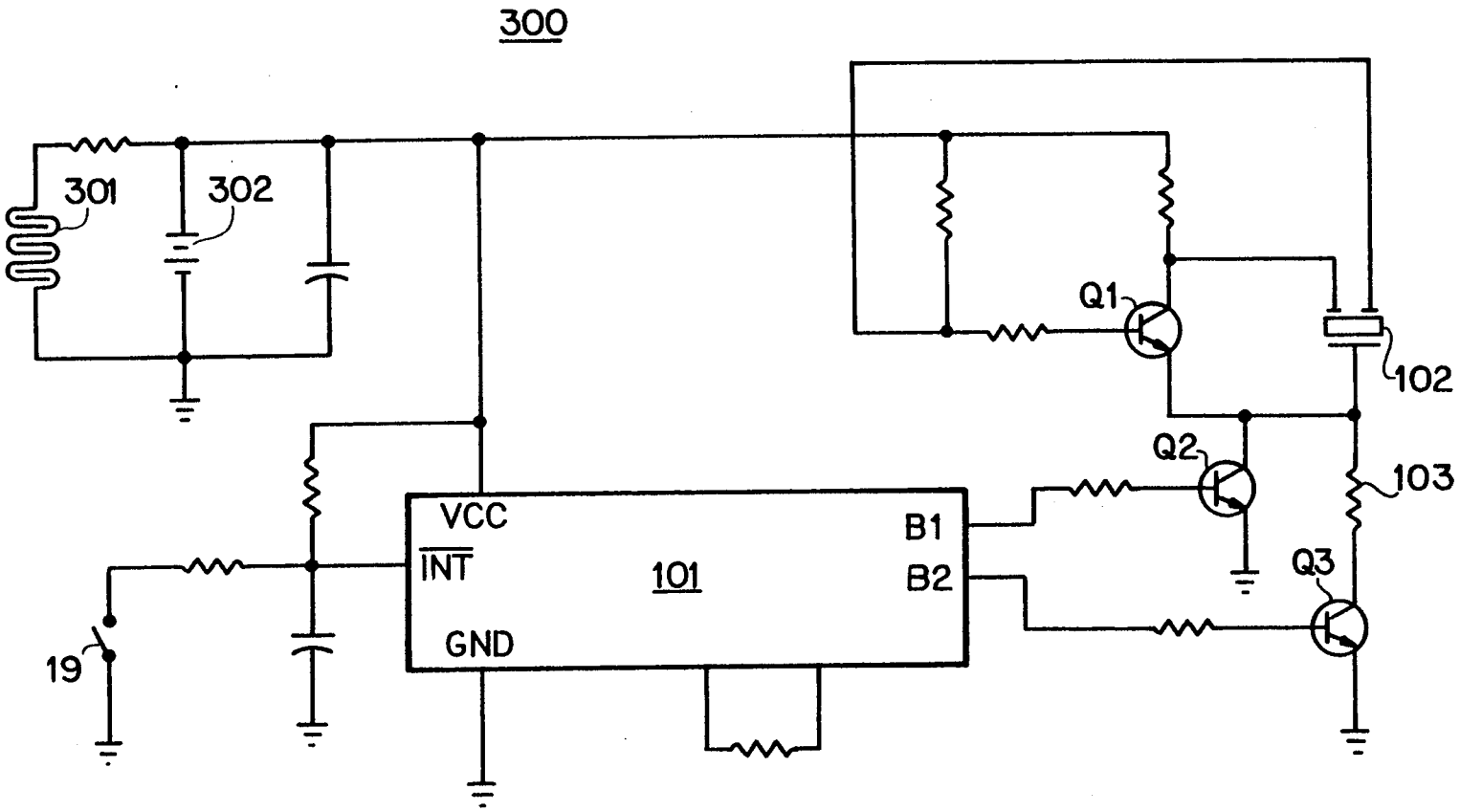
FIG. 9 is a schematic of the second microprocessor embodiment of the circuit.

A second microprocessor embodiment 300 is shown in schematic form in FIG. 9 which is essentially identical to the first microprocessor embodiment with the exception of the addition of a solar cell 301 and the substitution of rechargeable NICAD type batteries 302 for the lithium cells. For bicycles which get heavy daylight use, such as rental bicycles, a solar cell and rechargeable batteries could eliminate the need for frequent battery changes. However, considering the long life of lithium batteries, this would likely only be desirable for bicycles which see extremely heavy use.

Figure 10:
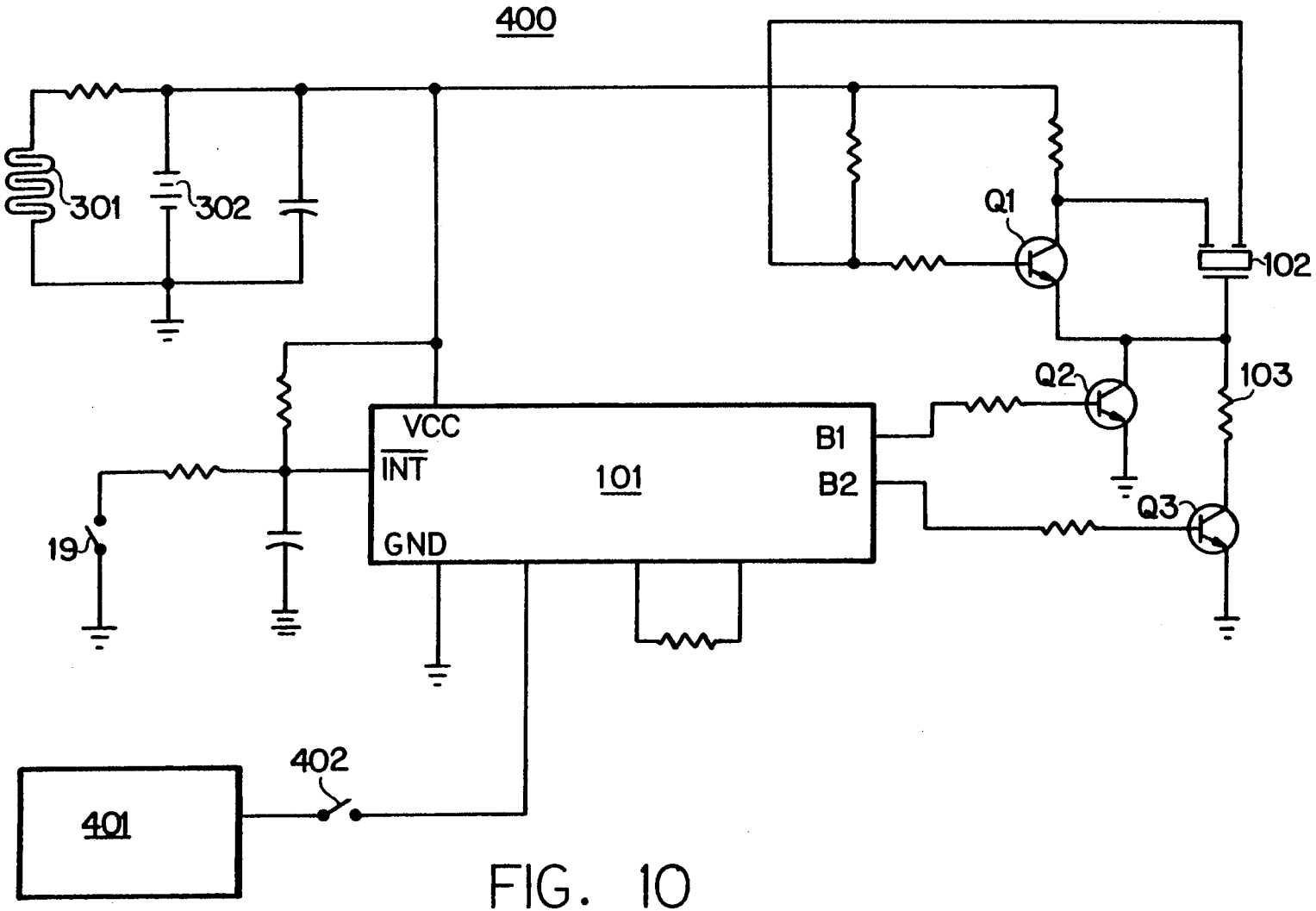
FIG. 10 is a schematic of the third microprocessor embodiment of the circuit.

A third microprocessor based embodiment 400 is schematically shown in FIG. 10. This embodiment incorporates a motion detector 401 which is selectively activated and deactivated via a key switch 402. Depending upon the specific configuration, the motion detection can be accomplished using a Hall effect or similar transducer, a device commonly associated with bicycle speedometers and odometers. Alternatively, the motion sensing function can be implemented using a mercury type switch or one of the newer solid state type devices.

In use, signaling device 10 is first installed by clamping it to the handle bar 2 of bicycle 1 using handle bar clamp 13. For a right handed rider, it is generally most convenient to clamp housing 11 closer to the left handle grip 4 and the momentary push button switch 19 in close proximity to the right handle grip 3 to allow the push button to be activated by the rider's right thumb. It should be apparent that the push button switch 19 could be positioned to be activated by virtually any other finger on either the rider's right or left hand. To warn a pedestrian or other path user that the rider is approaching without unnecessarily alarming that person, the rider need only to depress the push button switch 19 once to sound a pleasant non-obtrusive sound which will alert others to the rider's presence. However, in a louder environment or in a desperate situation, the rider simply depresses switch 19 twice in rapid succession to activate the loud continuous attention getting signal. To deactivate this signal, the rider depresses switch 19 once more. To activate the burglar alarm feature, the rider first parks her bicycle and then inserts her key into key switch and turns either to the right or left. The same procedure is followed to deactivate the alarm feature.

While there is shown and described the present preferred embodiment of the invention, it is to be distinctly understood that this invention is not limited thereto but may be variously embodied to practice within the scope of the following claims.

I claim:

1. An electronic warning device for use in recreational activities which comprises:

a single push button switch;

first electronic sound generation means being responsive to a single depression of said push button switch and configured to produce a first sound of limited duration to warn others of an approaching person;

second electronic sound generation means being responsive to two consecutive depressions of said push button switch and configured to produce a second continuing sound, said second continuing sound being louder than said first sound of limited duration, to immediately alert others of an approaching person;

sound deactivation means being electrically connected to said second sound generation means and responsive to an additional depression following the two consecutive depressions of said push button switch and configured to deactivate said second sound generation means; and power supply means being electrically connected to said first and second sound generation means and to said sound deactivation means for providing power to the same.

2. The warning device of claim 1 further comprising:

motion detection means being electrically connected to said second sound generation means and configured to activate said second sound generation means in response to movement of the detection means; and a key switch being electrically connected to said motion detection means for selectively activating said motion detection means.

3. The warning device of claim 1 wherein said power supply means comprises:

a rechargeable battery; and a solar cell being electrically connected to said rechargeable battery for charging the same in response to sunlight received by said solar cell.

4. The warning device of claim 1 wherein said first electronic sound generation means is also responsive to three consecutive depressions of said push button switch and configured to produce said first sound which continuously repeats to sound periodically; and, said sound deactivation means is also electrically connected to said first sound generation means and responsive to an additional depression following the three consecutive depressions of said push button switch and configured to deactivate said first sound generation means.

5. The warning device of claim 1 wherein the first sound generation means, the second sound generation means and the sound deactivation means comprise:

a microprocessor having an input responsive to a plurality of sequences of depressions of said push button switch and a ROM configured to selectively produce at an output on said microprocessor either a first signal of limited duration in response to a single depression of said push button switch, or a second signal of continuous duration in response to two consecutive depressions of said push button switch, said ROM further being configured to selectively deactivate said second signal upon an additional depression following the two consecutive depressions of said push button switch; and a sound transducer being electrically connected to said output on said microprocessor and further configured to produce said first sound of limited duration upon receiving said first signal and said second continuing sound, said sound continuing sound being louder than said first sound of limited duration, upon receiving said second signal.

* * * * *